United States Patent [19]

Ellwood et al.

[11] 4,304,447

[45] Dec. 8, 1981

[54] WALL CABINET FOR CONCEALED STORAGE

[76] Inventors: Gloria Ellwood, 331 21st St., Santa Monica, Calif. 90402; Milton Hoffman, 13745 Bessemer St., Van Nuys, Calif. 91401

[21] Appl. No.: 170,010

[22] Filed: Jul. 18, 1980

[51] Int. Cl.[3] ..... A47B 67/02; E05D 5/06; A47F 5/08

[52] U.S. Cl. ..... 312/204; 312/227; 312/242; 312/245; 312/248; 16/135

[58] Field of Search ..... 312/204, 227, 242, 245, 312/248; 16/135; 248/289.1

[56] References Cited

U.S. PATENT DOCUMENTS

| | | | |
|---|---|---|---|
| 258,720 | 5/1882 | Dickson | 312/248 |
| 1,666,240 | 4/1928 | Hubert | 312/204 |
| 1,948,775 | 2/1934 | Teller et al. | 16/135 |
| 2,073,119 | 3/1937 | Phiel | 16/135 |
| 2,114,644 | 4/1938 | Bennett | 16/135 |
| 2,439,664 | 4/1948 | Marchand | 312/242 |
| 2,589,370 | 3/1952 | Grennan | 312/248 |
| 2,754,991 | 7/1956 | Hagerty et al. | 312/242 |
| 3,016,563 | 1/1962 | De-Jong | 16/135 |
| 3,027,215 | 3/1962 | Duncan | 312/245 |
| 3,140,134 | 7/1964 | Nairn | 312/204 |
| 3,684,344 | 8/1972 | Gilinger | 312/204 |
| 3,918,782 | 11/1975 | Allmand | 312/204 |
| 3,930,702 | 1/1976 | Pichowicz | 312/245 |
| 4,134,625 | 1/1979 | Palka | 312/245 |
| 4,155,608 | 5/1979 | Orlewicz | 312/204 |
| 4,209,212 | 6/1980 | McGoldrick | 312/245 |

FOREIGN PATENT DOCUMENTS

| | | | |
|---|---|---|---|
| 504466 | 7/1951 | Belgium | 312/248 |

*Primary Examiner*—Victor N. Sakran
*Attorney, Agent, or Firm*—Lawrence Fleming

[57] ABSTRACT

A shallow cabinet attachable to the surface of a wall and resembling a framed picture when closed, and suitable for storing small objects of value such as jewelry. The cabinet comprises a pair of shallow box-like elements; a first element or wall box is attachable to the surface of a wall with its open side facing outward, and a second, cover-like element is hinged to the wall box element and disposed to cover and conceal it when swung closed. The outer face or panel of the cover-like box element may be ornamented by a picture or the like, or may be covered by a mirror. The vertical interior surfaces of both elements are preferably lined with cork board or like material covered with felt or velvet, to accept pins or hooks on which, e.g., bracelets and necklaces may be hung.

5 Claims, 5 Drawing Figures

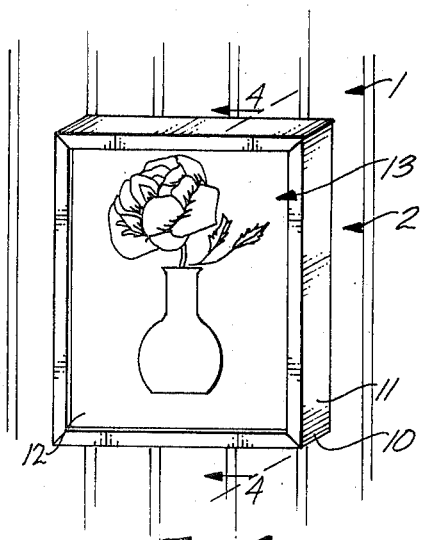
Fig. 1
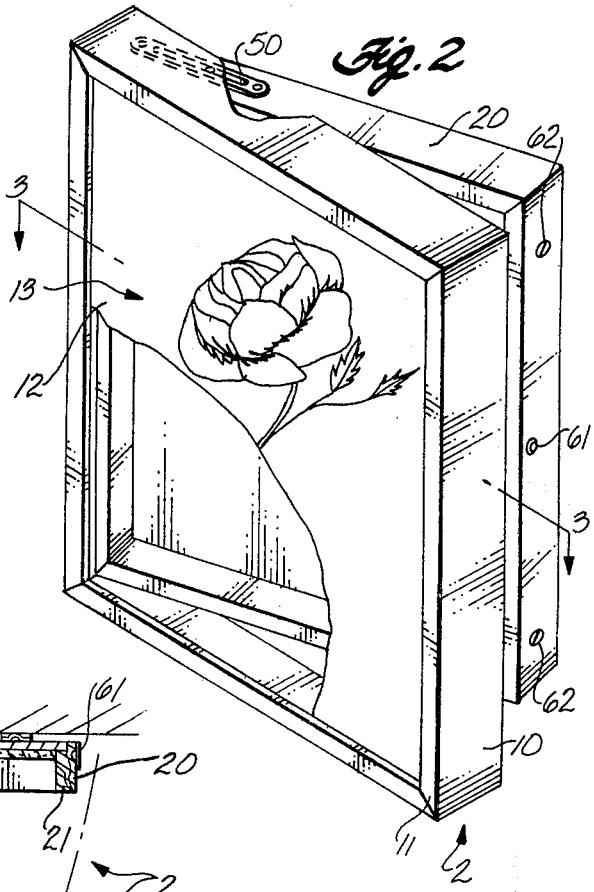
Fig. 2
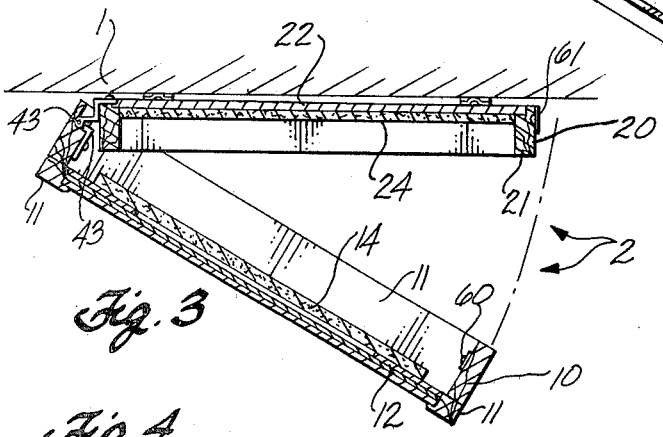
Fig. 3
Fig. 4
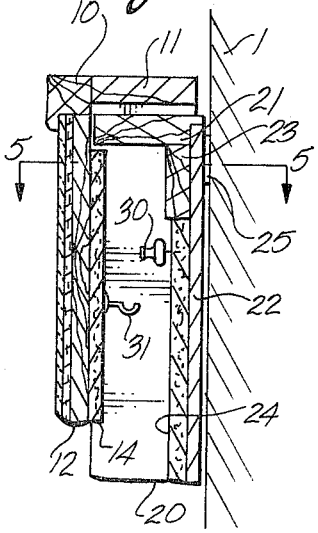
Fig. 5
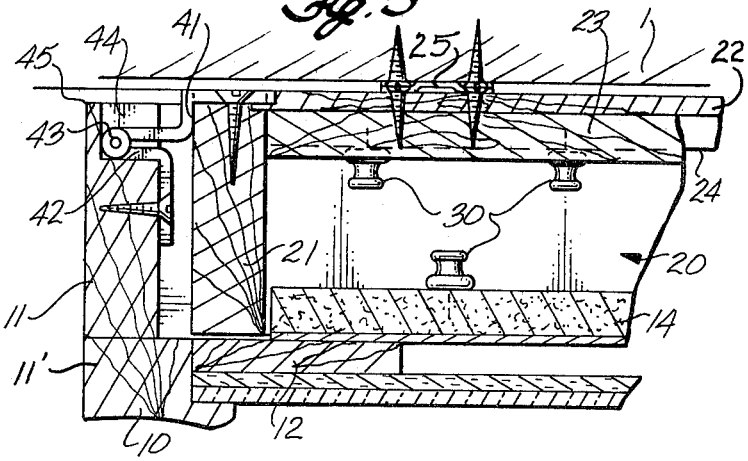

WALL CABINET FOR CONCEALED STORAGE

BACKGROUND

1. Field of Invention

This invention relates to cabinets or the like which are attachable to a wall for storing jewelry or other compact objects of value. More particularly it relates to such a cabinet whose exterior conceals those parts that relate to its functioning as an openable cabinet or container, and whose appearance conceals its actual nature.

2. Prior Art

The closest prior art of which we are aware shows wall cabinets of three general kinds: (1) Cabinets fitted into a recess in a wall; (2) Cabinets fastened to the surface of a wall and having a hinged door; and (3) Cabinets of the nature of either of the above which are also equipped with a secret compartment located behind the false back wall.

The closest examples of such art are believed to be the following U.S. patents, found in preliminary search:

1. Allmand, U.S. Pat. Nos. 3,918,782 and Orlewicz 4,155,608 shows cabinets recessed into a wall with covers that may resemble framed pictures.

2. Gilinger, U.S. Pat. No. 3,684,344 shows a surface cabinet.

3. Nairn, U.S. Pat. No. 3,140,134 shows a recessed cabinet with a secret compartment behind a false back wall.

BRIEF DESCRIPTION

A cabinet for jewelry or the like is attachable to the surface of a wall and made in the form of two nesting shallow boxes or box-like elements hinged together. The first element, or wall box, is adapted to be fastened to a wall with its open side facing outward. The second element or cover is hinged to the first so that in the open position the interiors of both are exposed, like an open attache case. The cover box element is, however, larger than the wall box so that in the closed position it covers and conceals the wall box. The outer panel of the cover box element is preferably covered with an ornamental device such as a picture; in the closed position the cabinet may look like a framed picture or mirror.

The hinges connecting the two elements are shaped and disposed so as to be concealed when the cover is closed. The hinge pins are located near a vertical outside rear edge of the cover so that when closed the cover lies almost in contact with the wall.

The inside vertical surfaces of both the above elements are preferably provided with liner boards of penetrable material such as cork board, which may be covered with ornamental cloth such as velvet. Suitable pins or hooks may then be pushed into the liner boards at points desired by the user, to hang necklaces, bracelets, or other objects on.

DETAILED DESCRIPTION

In the Drawing

FIG. 1 is a perspective view of a cabinet of the invention in closed position, fastened on a wall;

FIG. 2 is a perspective view of a similar cabinet partly open;

FIG. 3 is a sectional view on line 3—3 of FIG. 2;

FIG. 4 is a partial sectional view on line 4—4 of FIG. 1; and

FIG. 5 is a partial sectional view on line 5—5 of FIG. 4.

Referring first to FIGS. 1 and 2, a cabinet according to the invention, indicated generally at 2, is attachable to the surface of a wall indicated at 1. The cabinet 2 has two main parts, an inner wall box or box-like element 20 and an outer cover or box-like element 10, FIGS. 1 and 2. Cover 10 and wall box 20 are hinged together along their left-hand edges, as shown in FIGS. 4 and 5, to be described in more detail later.

Cover 10 has a frame-like portion 11 surrounding and holding an outer panel 12 which may be ornamented with a picture as indicated at 13, FIGS. 1 and 2, or with some other kind of ornamentation or with a mirror.

The wall box or element 10 similarly comprises a frame-like portion 21 and a panel 22, best seen in FIGS. 3–5. Panel 22 is at the back, disposed against the wall. A portion 23 of the back of wall box 20 is preferably made of heavier material to provide a stronger anchor for mounting to the wall 1, FIGS. 4 and 5. Flush mounting brackets 25 of known type, FIGS. 3–5, may be used to attach the cabinet to the wall 1.

Referring now particularly to FIGS. 3 and 5, the cover 10 is hinged as by hinge 41–43 to wall box 20. Two or more such hinges connect the frame portions 11 and 21 of the two box-like elements. The hinge pivot or pin 43 is located close to the back edge 45 of frame 11, FIG. 5. This permits the frame members 11 to lie close to the wall 1 when cover 10 is closed, so that the closed cabinet appears to an observer merely as a frame 11 and panel 12 with picture 13, attached to the wall, with nothing in back of them. To this end, a portion of frame portion 11, FIG. 5, is cut away or hollowed out at 44 to make room for the hinge pin portion 43 and the adjacent portions of the wings 41, 42 of the hinge. It will be seen that these wing portions are bent into shapes such that their attaching screws are concealed when the cabinet is closed.

The frame members 11, 21 may suitably be made of wood and the panels 12, 22 of plywood or of a suitable hard composition board. For ease of manufacture the frame members of cover 10, FIG. 5, may be made of separate pieces 11, 11', glued together. Portion 11 may be of rectangular cross-section and portion 11' of picture frame molding or the like.

Liner boards 14, 24 preferably of cork board or other relatively soft penetrable material are shown in FIGS. 3–5. Their exposed surfaces may preferably be covered with felt or velvet or other suitable material (not shown). Hooks 31 or pins 30, FIGS. 4–5, may be inserted into the liner boards at desired places to provide means to hang objects such as necklaces, chains, bracelets and rings.

A lid stop of a suitable known type such as a slide stop 50, FIG. 2, may be provided to restrict the angle of opening of cover 10 to, e.g., about 90 degrees.

The outside dimensions of cover box element 10 in one satisfactory model of the invention are about 22 inches high by 18 inches wide by 3 inches deep (56×46×8 cm). Frame members 11, 21 may be about ¾ inch (2 cm) thick.

A button catch or other suitable latching or locking device may be provided as at 60, 61 in FIGS. 2–3. To provide additional holding force to tend to keep the cover closed, button-shaped magnets or the like as at 62, 62, FIG. 2, may be employed, with suitable iron armatures, not shown, mounted on the inside of frame 11 of cover 10 so as to lie opposite them when the cover is closed.

Suitable concealed locking means and burglar alarm devices are considered useful additions but do not form a part of the present invention.

I claim:

1. A cabinet for the concealed storage of small objects, comprising:

a shallow wall box element having first narrow side frame portions defining a first shallow depth, an open front portion, and a generally solid back portion adapted to be fastened vertically against the flat unrecessed surface of a wall;

a shallow cover box element having: an open back portion, a front portion closed by a solid ornamental panel, and second narrow side frame portions defining a second depth and extending outside of said first side frame portions to permit said cover box element to fit over and conceal the whole of said wall box element, said second depth being equal to or greater than said first depth; and hinge means connecting both said elements to permit said cover box element to swing between an open position exposing the interiors of both said elements, and a closed position;

said cover box element in said closed position covering substantially completely said wall box element in a nesting manner and with its said second narrow side portions extending close to said wall and providing the appearance of a framed picture or the like, and concealing said hinge means.

2. A cabinet as in claim 1, wherein:

said hinge means comprise hinges with hinge pins whose axes lie close to a vertical rear edge of said cover box element, and cut-out portions in said element in which are disposed said hinge pins and adjacent portions of said hinges.

3. A cabinet as in claim 2, wherein:

one wing portion of each hinge is shaped to provide an attachment portion lying across a rear surface of a portion of said wall box element, and the other wing portion of said hinge is bent at right angles to provide an attachment portion on an inner wall portion of said cover box element.

4. A cabinet as in claim 1, further comprising an ornamental picture on said front panel.

5. A cabinet as in claim 4, further comprising:

liner boards in both said elements of penetrable material adapted to the insertion of pins and disposed adjacent the inner surfaces of said vertical rear side and of said front panel, whereby jewelry may be hung from said pins for concealed storage.

* * * * *